United States Patent [19]

Yamasaki

[11] Patent Number: 4,924,535

[45] Date of Patent: May 15, 1990

[54] HIGH-SPEED EMITTING APPARATUS OF MIXED FLUID FOR USE IN A BATHTUB

[75] Inventor: Yoshikiyo Yamasaki, Osaka, Japan

[73] Assignees: Kabushiki Kaisha Fuji Iryoki, Osaka; Kabushiki Kaisha Japan Health, Tokyo, both of Japan

[21] Appl. No.: 280,502

[22] Filed: Dec. 6, 1988

[51] Int. Cl.[5] ..... A61H 33/02

[52] U.S. Cl. ..... 4/544; 4/492; 4/568; 128/66

[58] Field of Search ..... 4/541, 542, 544, 492, 4/567, 568; 128/66

[56] References Cited

U.S. PATENT DOCUMENTS

| | | | |
|---|---|---|---|
| 3,038,469 | 6/1962 | Jacuzzi | 128/66 |
| 3,273,560 | 9/1966 | Jacuzzi | 128/66 |
| 3,411,499 | 11/1968 | Jacuzzi | 128/66 |
| 3,534,730 | 10/1970 | Jacuzzi | 128/66 |
| 3,802,422 | 4/1974 | Hurst | 128/66 |
| 3,902,529 | 9/1975 | Brown | 138/103 |
| 4,121,903 | 10/1978 | Smolka | 8/137 |
| 4,255,148 | 3/1981 | Reinwald et al. | 8/137 |
| 4,282,866 | 8/1981 | Miffitt | 128/66 |
| 4,563,782 | 1/1986 | Dijkhuizen | 4/542 |
| 4,726,917 | 2/1988 | Abe | 261/36.1 |

FOREIGN PATENT DOCUMENTS

| | | | |
|---|---|---|---|
| 210821 | 2/1987 | European Pat. Off. | 4/541 |
| 2034054 | 7/1972 | Fed. Rep. of Germany | 4/541 |
| 2872977 | 1/1979 | Fed. Rep. of Germany | 4/542 |
| 62-2041 | 1/1987 | Japan . | |
| 62-2042 | 1/1987 | Japan . | |
| 62-204747 | 9/1987 | Japan . | |

*Primary Examiner*—Henry J. Recla
*Assistant Examiner*—R. M. Fetsuga
*Attorney, Agent, or Firm*—Flynn, Thiel, Boutell & Tanis

[57] ABSTRACT

An apparatus positionable within a bathtub for discharging a jet stream of warm water, as sucked from the bathtub, having air bubbles mixed therein to cleanse and massage a part of the human body. The apparatus includes a main body for emitting the jet stream and a source of electricity positioned outside the bathtub. The main body is set directly within the bathtub. The pumping mechanism within the main body sucks liquid from the bathtub through an inlet and through a special filter, sucks the surrounding environment through an air inlet, mixes these within a mixing part, and discharges the mixture through an emitting nozzle as a high-speed jet stream. The emitted mixed fluid is discharged directly to a part of the bathing human body to massage and stimulate the body. The stimulus upon explosion of the included bubbles makes it possible to cleanse the body part efficiently.

10 Claims, 3 Drawing Sheets

HIGH-SPEED EMITTING APPARATUS OF MIXED FLUID FOR USE IN A BATHTUB

BACKGROUND OF THE INVENTION

1. Field of the Invention

This invention relates to the high-speed emitting apparatus of mixed fluid for a domestic bathtub to permit massaging parts of the human body with an appropriate stimulation, subject to sucking the warmed water within the bathtub and to emitting a mixture of warmed water and air bubbles at high-speed against a part of the body.

2. Description of the Prior Art

It is empirically known that, subject to warming the human body in warmed water within a bathtub, it can stimulate the circulation of the blood and relieve a crick in the shoulders or muscular fatigue. In recent years, it has become known that, by generating bubbles in the bathtub and impacting the body with bubbles, it relieves a crick in the shoulders or muscular fatigue as have been thought, or otherwise has a good effect on the beauty of the face or on the health of the body. For example, a suction inlet set in the bathtub is connected with an emitting outlet, through a circulation pump by which the water in the bathtub is compulsively circulated through a circulation path. The path is separated, on the side of the lower course of the pump, into two paths, one of which is a bypass path. On the path, the bypass pump and the filter are set to filter a part of the circulating water at the filter. As the filtrating materials of the filter, there is used fibers, and particles of glass beads and silica sand etc. Regarding the former, the fiber is used in a cartridge form. In case of the latter, the particles of glass beads etc. are arranged the pipe of the path, and by having the water in the bypass path flow reversely, it is possible to cleanse the filter. But, concerning the conventional bubble generating apparatus as described above, the structure of this apparatus is complex, and if such bubble generating apparatus is installed within the bathtub, there arises difficulties such that it requires largescale work and a substantial installment cost.

SUMMARY OF THE INVENTION

The high-speed emitting apparatus for a domestic bathtub of the invention overcomes the above problems and includes a pump for sucking the liquid, a hose for discharging the liquid and a hose for sucking air within the main body, and is preferably of compact size. By setting the main body of the apparatus within the bathtub and connecting it to the source of electricity on the outside, the pump sucks the liquid in the bathtub and feeds the liquid to the hose for discharging the liquid in order to absorb air supplied by the air hose to mix the sucked liquid with the sucked outside air, and to then discharge the mixture of liquid and air at high speed. Subject to emitting the mixture (the mixed fluid) toward a part of the human body within the bathtub, the apparatus of the invention makes it possible to massage with the proper stimulation or to cleanse the body. Furthermore, with the invention it is possible to filter the liquid in the bathtub, when circulated through the main body, by setting a special filter at the liquid inlet which is positioned at the bottom of the main body.

Accordingly, the object of the invention is to provide a high-speed emitting apparatus for a mixed fluid for use in a domestic bathtub which emits at high speed a mixed fluid including outside air bubbles mixed with the liquid in the bathtub, which is preferably of compact size and can be positioned directly in the bathtub to massage a bathing body with proper stimulus and to increase the cleansing effect of the human body due to the stimulation of the included bubbles upon explosion, and which is inexpensive and easy to position and operate.

Another object of the invention is to provide a high-speed emitting apparatus, as aforesaid, which makes it possible to use the water (liquid) for many hours by filtering the liquid in the bathtub as it circulates through the main body.

DETAILED DESCRIPTION

Figure 1:
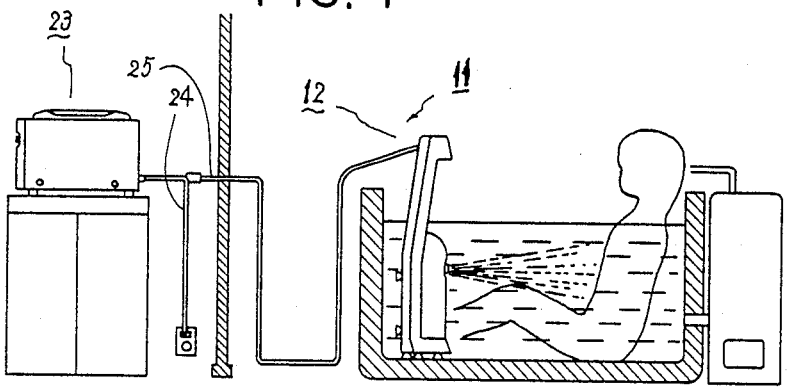
FIG. 1 is a side elevational view which shows an example of the high-speed emitting apparatus of the invention.
Figure 2:
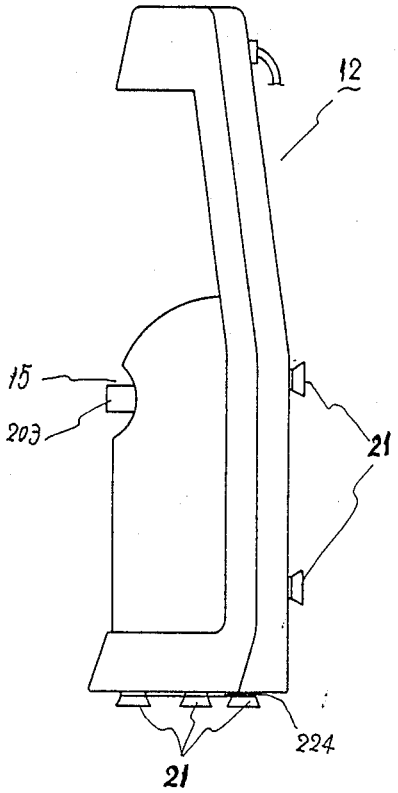
FIG. 2 is a side elevational view of the main body of the apparatus.
Figure 3:
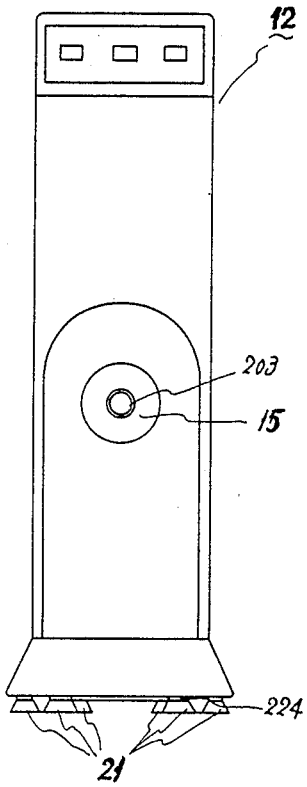
FIG. 3 is a front elevational view of the main body of the emitting apparatus.
Figure 4:
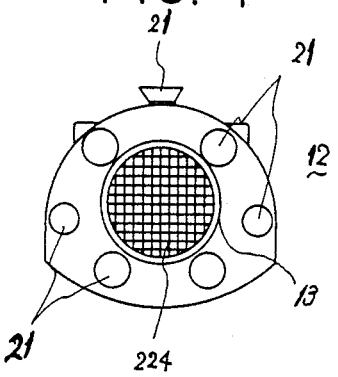
FIG. 4 is a bottom plan view of the apparatus shown in FIG. 3.
Figure 5:
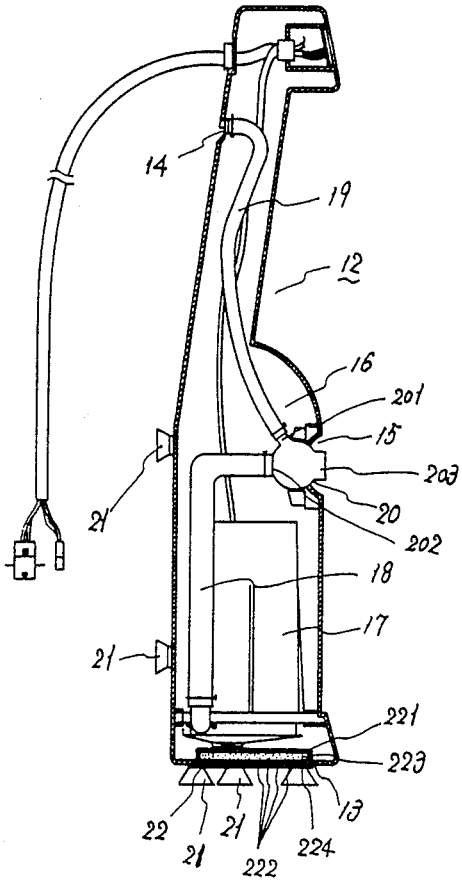
FIG. 5 is a longitudinal sectional view which shows the inner structure of the main body of the emitting apparatus.
Figure 6:
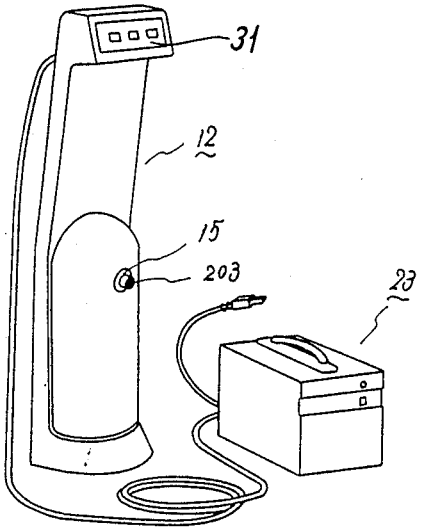
FIG. 6 is an explanatory view which shows the apparatus and its source of electricity.
Figure 7:
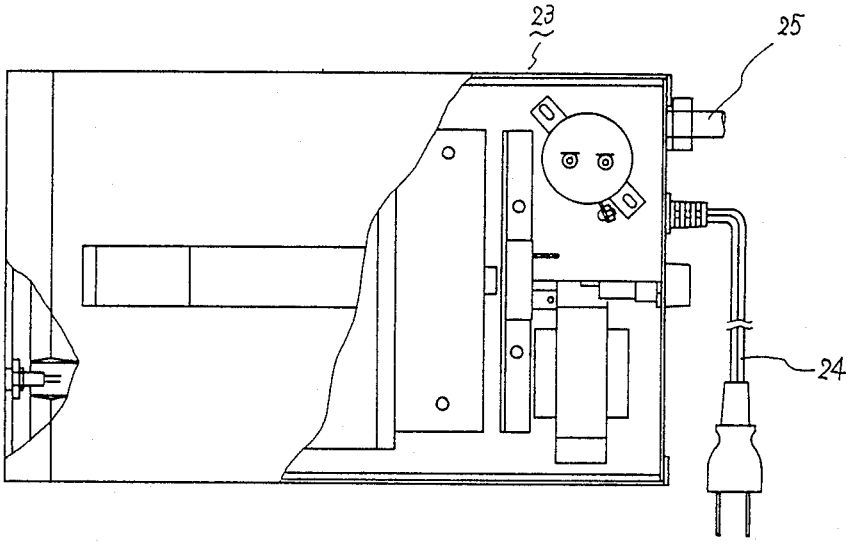
FIG. 7 is another explanatory view which shows the source of electricity for the apparatus.

The high-speed emitting apparatus of mixed fluid for use in a domestic bathtub is designated 11 and comprises a main body or apparatus 12 and a power unit 23 which operates the apparatus 12. The main body or apparatus 12 is positionable within the bathtub, and sucks the liquid in the bathtub and mixes the outdoor air therewith, thereby emitting the mixture (the mixed fluid). The main body 12 is of a closed but hollow construction, and is vertically elongate. The inlet 13 for sucking the liquid from within the bathtub is defined at the lower part of the body 12, and the inlet 14 for air is defined at the upper back part of the body 12. At the front, approximately middle part of the main body 12, there is defined a discharge or emitting opening 15 through which the mixture is discharged. And, on the bottom wall and on the lower part of the back wall of the main body 12, there are mounted suction cups or discs 21 which are adapted to be stuck to the bottom and side of the bathtub, so as to fixedly but removably position the main body 12 within the bathtub.

A mechanism 16 for emitting the fluid mixture is mounted within the main body 12 so as to mix the outside air with the sucked liquid from within the bathtub, and then discharge the mixture through the outlet 15.

The mechanism 16 comprises a pump 17 for sucking the liquid from the bathtub through the inlet 13, a hose 18 for guiding the liquid from the pump outlet to the emitting outlet 15, a hose 19 connected to air inlet 14 for sucking air to the emitting outlet 15, and a globe-shaped mixing element or tube 20 for mixing the liquid and the air. The mixing element 20 has a hole 201 connected to hose 19 for sucking the air, a hole 202 connected to hose 18 for sucking the liquid, and a discharge tube or nozzle 203 projecting through the mixing element for emitting the liquid 203 of the emitting outlet 15 for discharging the mixture. At the globe-shaped mixing tube 20, the liquid supplied by the pump 17 is mixed with the outside air sucked through the hose 19, and then the mixture is discharged at high speed from the nozzle tube 203. Furthermore, the mixture (the mixed fluid) is emitted at high speed from the tube 203 because the outside air enters into and is mixed with the liquid within the globe-shaped mixing tube, wherein the air is compressed and accelerated and emitted as bubbles entrained in the liquid.

The member 20 is swivelably supported in the main body, whereby the direction of the discharged jet stream can be manually angularly adjusted.

Because the bubbles in the mixture as emitted from the tube 203 are of comparatively small size due to the suction and high speed, supersonic waves are generated upon expansion and explosion of the bubbles.

Element 22 is a filter positioned at the inlet 13 of the main body 12. The filter 22 comprises a filter casing 221 having flow circulation holes 222 through the upper and lower walls thereof. The casing 221 confines therein a filter member 223 which preferably comprises a platelike porous member formed of a suitable powder-like material. A further meshlike filter plate 224 is positioned over the lower (i.e. inlet side) of the filter 22. This filtering arrangement makes it possible to remove the sucked floating substances with large radii in the bathtub liquid by using the circular filter 224, and further makes it possible to remove the injurious or odor-causing organic substances by use of the filter 22, whereby the water (liquid) within the bathtub can be cleansed.

Furthermore, as the material for the filter element 223, natural minerals having numerous holes and having a decolorized or deodorized matter are comparatively good to use. For example, it is possible to use one kind or a mixture of two or more kinds of the following substances: silicic acid anhydrade compounds (quartz, silica sand, diatomaceous earth class etc.), alumina silicic acid anhydrade compounds (sillimanite fibrolite, mull stone etc.), alumina silicic acid hydrade compounds (kaolin, zeolite, sericite, montmorillonite etc.), potassium alumina silicic acid compounds (potassium feldspar, muscovite etc.), soda alumina silicic acid compounds (soda feldspar, jade etc.), magnesium alumina silicic acid compounds (phlogopite etc.), magnesium silicic acid compounds (talc, glauconite etc.), and so on.

Figure 8:
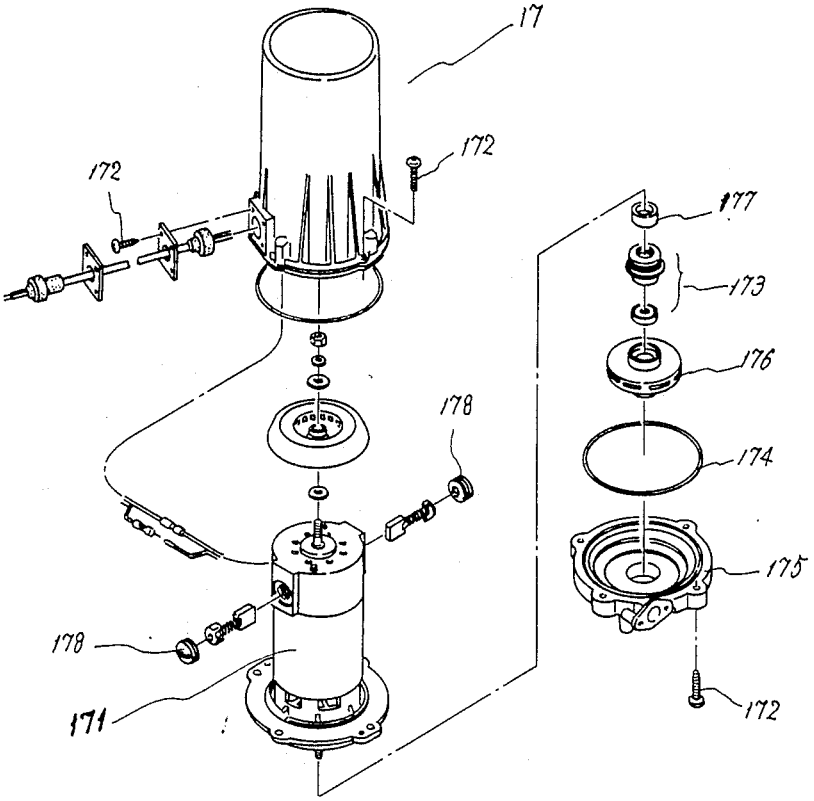
FIG. 8 is an exploded view which shows the pump for sucking the liquid within the main body.

The power unit 23 is set outside the bathtub and supplies electric power to operate the mechanism 16. Cord 24 connects a source of conventional AC electricity with the unit 23. The power unit 23 converts conventional AC electricity to low-voltage DC electricity. The intermediate cord 25 connects the main body 12 of the apparatus with the power unit 23. The pump 17 is operated bY low-voltage DC electric power supplied bY the power unit 23 through the intermediate cord 25. The structure of the pump 17 is generally conventional. One possible construction of the pump 17 is shown as FIG. 8 wherein 171 is a motor, 172 is a screw, 173 is a mechanical seal, 174 is an 0-ring, 175 is a casing, 176 is an impeller, 177 is an oil seal and 178 is a brush cap.

To use the apparatus 11, the main body 12 is positioned in the bathtub at one side thereof by means of the suction discs 21. The power unit 23 is remotely located, preferably in a different room, and is connected to the main body 12 by the intermediate cord 25. The user in the bathtub can operate the pump 17 by means of an ON-OFF switch associated with the control panel 31. The pump 17 sucks the liquid through the inlet 13 and through the filters, thereby filtering the floating substances with large radii and the organic substances within the bathtub. The liquid is fed by the pump to the globe-shaped tube 20 which thus causes the air to be sucked through the tube 19. Within the globe-shaped tube 20, the liquid and the air are mixed, and the resulting mixture including air bubbles is discharged in the form of a high-speed jet stream from the nozzle 203. By permitting this jet stream to impinge against selected parts of the bather's body makes it possible to appropriately massage and stimulate the body, and to remove waste matters and secretions from those parts of the body.

What is claimed is:

1. An apparatus for use in a bathtub for emitting a high-speed jet of liquid having air bubbles entrained therein, comprising:

a thin-wall hollow main body defining therein a contiguous and undivided vertically extending interior cavity and having a lower inlet for sucking the liquid, an upper inlet for sucking air, and an emitting nozzle;

a mechanism disposed within the main body for creating and emitting the jet including a pump communicating with the liquid inlet for sucking the liquid from the bathtub through the lower inlet and into the pump, a hose for supplying pressurized liquid from the pump to the emitting nozzle, and a hose for sucking air from the upper inlet into the emitting nozzle so that the air can be mixed with the liquid;

a filter mounted on the main body at the lower inlet and vertically aligned therewith, the emitting nozzle, the pump, and the hoses each being positioned in the interior cavity of the main body and each being in vertical overlying relationship relative to the lower inlet and the filter;

suction discs mounted on the main body for releasably securing the main body to the bathtub; and a source of electricity for operating the mechanism.

2. An apparatus for use in a domestic bathtub for emitting a high-speed jet of liquid having air bubbles entrained therein, comprising:

a hollow and vertically elongate body adapted to be positioned directly within a domestic bathtub, said hollow body defining therein a contiguous vertically extending interior cavity, said body having means associated therewith for stationarily securing the body to the bathtub;

pump means disposed within the interior of said body;

an inlet formed in said body adjacent the lower end thereof so as to be disposed below the surface level of the liquid within the bathtub, said inlet communicating with said pump means for permitting the liquid in the bathtub to be sucked through the inlet into the pump means;

discharge nozzle means mounted on said body at a location spaced upwardly from the lower end thereof for permitting discharge of the jet therefrom;

first conduit means disposed within said body and connected between said discharge nozzle means and the outlet of said pump means for permitting pressurized fluid from the pump means to be supplied to and discharged through the discharge nozzle means;

an air inlet formed in said body adjacent an upper end thereof;

suction conduit means connected between said air inlet and said discharge nozzle means for permitting air to be sucked therethrough into said discharge nozzle means for mixing with the liquid so as to cause air bubbles to be entrained in the liquid as it is discharged through said discharge nozzle means, said suction conduit means, said discharge nozzle means, said first conduit means, and said pump means each being positioned in said interior cavity of said hollow body and each being in vertically overlying relationship relative to said inlet; and a low-voltage direct-current electrical power unit connected to said pump for effecting operation thereof, said power unit being provided separately from said hollow body.

3. An apparatus according to claim 2, wherein said hollow body has said pump mounted therein adjacent the lower end thereof, said liquid inlet being disposed adjacent a bottom wall of said hollow body, said discharge nozzle means being located in a central part of said hollow body as located between the upper and lower ends thereof, and a control panel mounted on said hollow body adjacent the upper end thereof.

4. An apparatus according to claim 3, wherein said securing means includes a plurality of suction cups mounted on said hollow body for releasably but securely attaching said hollow body to said bathtub.

5. An apparatus according to claim 2, wherein said securing means includes a plurality of suction cups mounted on said hollow body for releasably but securely attaching said hollow body to said bathtub.

6. An apparatus according to claim 2, wherein said discharge nozzle means is swivelably mounted on said hollow body to permit the direction of discharge of said jet to be angularly adjusted.

7. An apparatus according to claim 1, wherein said filter is removably mounted on said main body so as to cover said lower inlet for filtering liquid as it is drawn into said body through said lower inlet, said filter including a first filter member for filtering large liquid-borne foreign particles and substances, and a second filter member for filtering unwanted organic substances from the liquid, said first filter member being disposed upstream of said second filter member.

8. An apparatus according to claim 7, wherein said second filter member includes a filter casing having opposed upper and lower walls and a filter element vertically confined therebetween, said upper and lower walls having a plurality of circulation holes formed therein to allow liquid to pass therethrough, said filter element being a platelike porous element made from a powder-like material.

9. An apparatus according to claim 8, wherein said first filter member is a mesh-like screen.

10. An apparatus according to claim 7, wherein said first filter member is a mesh-like screen.

* * * * *